US005109746A

United States Patent [19]

Takauji et al.

[11] Patent Number: 5,109,746

[45] Date of Patent: May 5, 1992

[54] ENVELOPE GENERATOR FOR USE IN AN ELECTRONIC MUSICAL INSTRUMENT

[75] Inventors: Kiyomi Takauji; Yutaka Washiyama, both of Hamamatsu, Japan

[73] Assignee: Kawai Musical Inst. Mfg. Co., Ltd., Sizuoka, Japan

[21] Appl. No.: 499,816

[22] Filed: Mar. 27, 1990

[30] Foreign Application Priority Data

Mar. 27, 1989 [JP] Japan ..... 1-74601

[51] Int. Cl.[5] ..... G10H 1/06; G10H 3/00

[52] U.S. Cl. ..... 84/607; 84/624; 84/626; 84/604

[58] Field of Search ..... 84/607, 626, 627, DIG. 20, 84/663, 604, 607, 627, 663, DIG. 2

[56] References Cited

U.S. PATENT DOCUMENTS 3,952,624 4/1976 Kawakami ..... 84/DIG. 20
4,154,133 5/1979 Kitawaga ..... 84/626
4,524,668 6/1985 Tomisawa et al. ..... 84/627
4,528,885 7/1985 Chihana ..... 84/626
4,612,838 9/1986 Nagashima et al. ..... 84/607
4,747,332 5/1988 Uchiyama et al. ..... 84/DIG. 20

*Primary Examiner*—William M. Shoop, Jr.
*Assistant Examiner*—Helen Kim

[57] ABSTRACT

An envelope generator for use in an electronic musical instrument comprises a musical tone data processing unit to evaluate a rate of change in a current value of musical tone envelope data with respect to a target value based on a parameter, a changing rate control unit for decrementing a change in the current value such that the current value becomes closer to the target value, a detection unit to detect whether or not the rate of change becomes equal to 0, and a processing control unit control for stopping the evaluation the current value in response to a result of the detection.

8 Claims, 5 Drawing Sheets $Y+(X-Y)\times SP$ $X+(Y-X)\times(1-SP)$

CKT. : CIRCUIT

ENVELOPE GENERATOR FOR USE IN AN ELECTRONIC MUSICAL INSTRUMENT

BACKGROUND OF THE INVENTION

1. Field of the Invention

This invention generally relates to an electronic musical instrument, and more particularly, to a musical tone information processing system for processing information on musical tones for use in an electronic musical instrument.

2. Description of the Related Art

Hereinafter, a conventional system for processing musical tone information such as envelope data in an electronic musical instrument as shown in FIG. 2 will be described with reference to FIGS. 1 (1) and 4 (1). Referring first to FIG. 4 (1), this figure shows a conventional envelope processing unit in which a current value Y of the voltage of an envelope used in the electronic musical instrument of FIG. 2 is made to approach a target value X in each of an attack time, a decay time and a release time of the envelope, by repeating a process comprised of the steps of multiplying the difference between the target value X and the current value Y by a parameter SP and then adding the result of the multiplication to the current value Y. Referring now to FIG. 1 (1), the target values X in the attack time, the decay time and the release time of the envelope are indicated by the target values I, II and III, respectively.

Referring back to FIG. 4 (1), the current value Y is first inverted by a complementer 51 to a two's complement thereof, and further, the resultant complement is added to the target value X in an adder 52; whereby, the current value Y is subtracted from the target value X and the difference (X−Y) between the values X and Y is evaluated. Subsequently, this difference data (X−Y) is multiplied by the parameter SP in the multiplier 53, and thus "change data" (X−Y)×SP is obtained. The parameter SP defines the magnitude of the rate of change (hereunder sometimes referred to as the changing rate) of the change data (X−Y)×SP, and as the value of this parameter SP is increased, the gradient or grade of the envelope curve shown in FIG. 1 (1) in the attack, decay or release time is decreased, and accordingly, the parameter SP has a character similar to a well known character of a time constant. Further, the change data (X−Y)×SP is added to the current value Y and the result of the addition is obtained as a new current value Y.

Nevertheless, when the current value Y becomes close to the target value X, although the current value Y is not yet equal to the target value X, the difference data (X−Y) or the change data (X−Y)×SP often becomes equal to 0, due to a truncation error, etc., and thus no matter how often the above-described process for making the current value Y approach the target value X is repeated, the current value Y does not become equal to the target value X but reaches or converges to limit values (hereunder sometimes referred to as actual limit values) I, II, and III, which are slightly different from the corresponding target values, I, II and III as shown in FIG. 1 (1). This hinders the transition from an attack phase (corresponding to the attack time) of the envelope to a decay phase (corresponding to the decay time) thereof, that from the decay phase thereof, to a release phase (corresponding to the release time) thereof, and the complete termination of the release phase thereof.

Therefore, the conventional envelope processing system is provided with a target value regulating device 55, and thus sets a current target value (hereunder sometimes referred to as a regulated target value) XT as a value closer to the current value Y than the original target value X by multiplying the original target value X by value regulating data. Further, along with the regualated target value XT, a new current value Y is supplied to a comparator 56, and when the regulated target value XT is matched with the thus-supplied current value Y, the comparator 56 outputs a coincidence signal to the target value generator 11 and the parameter generator 12 as an achievement signal indicating that the current value Y is matched with the regulated target value XT. Note, for example, where the original target value X is reduced by 10%, the value regulating data is set at 0.9. Furthermore, for example where the current value Y is decreased toward the target value X as in the decay phase of the envelope, and further, the original target value X is increased by 10%, the value regulating data is set at 1.1. Moreover, to regulate the target value X, a constant value may be added to the target value instead of multiplying the original target value by the value regulating data.

Accordingly, the conventional envelope information processing system has drawbacks in that the construction of the circuit is complex, because of the provision of the target value regulating device 55, and that the content of the processing is also complex because of the need to change the value regulating value in accordance with the kind of the target value X. For example, in the above-described case, the original target value X is multiplied by the value regulating data of 0.9 if the value X is the regulated target value I at the terminal point of the attack phase, is multiplied by the value regulating data of 1.1 if the value X is the regulated target value II at the terminal point of the decay phase, and the constant value is added to the original target value X if the value X is the regulated value III at the terminal point of the release time. Namely, in the conventional envelope information processing system, the values of the value regulating data must be changed in turn, and further, the kinds of operations used for obtaining the values of the value regulating data from the multiplication and the addition must be selected. The present invention has been created to eliminate the drawbacks of the conventional system.

Therefore, and object of the present invention is to provide a musical tone information processing system in which a judgement of whether or not the target value is achieved can be easily obtained by using a circuit having a simple structure.

SUMMARY OF THE INVENTION

To achieve the foregoing object, and in accordance with the present invention, there is provided a musical tone information processing system which comprises musical tone data processing means for evaluating a rate of change in a current value of musical tone data with respect to a target value, changing rate control means for updating the current value of the musical tone data such that the current value becomes closer to the target value, detection means for detecting whether or not the rate of change becomes equal to 0, and issuing a coincidence signal indicating that the current value has become equal to the target value when the rate of change becomes equal to 0, and processing control means for controlling the musical tone data processing means in response to the coincidence signal issued from said detection means.

Therefore, when repeating the process of making the current value approach the target value by updating the current value of the musical tone data, by setting the value of the expression such as (the target value+(the current value−the target value)×the value of a parameter funciton SP(x)) as a new current value, the current value always becomes equal to the target value when the changing rate of the change data ((the current value−the target value)×the value of a parameter function SP(x)) becomes equal to 0 and the current value becomes unchangeable. Further, in this case, only the determining of whether or not the changing rate has become equal to 0 is effected, and it is not necessary to provide a unit for regulating the value of the target value, obtain and change value changing data in accordance with the kind of the of the target value used for the judgement, and obtain the value indicating the judgment, and thus the construction of the circuit can be simplified. Further, the processing of the judgement, or that of making the current value equal to the target value, can be subsantially simplified. Note, the expression used in the repeated process of making the current value approach the target value is not limited to that described above.

BRIEF DESCRIPTION OF THE DRAWINGS

Other features, objects and advantages of the present invention will become apparent from the following description of a preferred embodiment with reference to the drawings, in which like reference characters designate like or corresponding parts throughout several views, and in which:

FIG. 1 (2) is a graph of an envelope waveform for illustrating a musical tone information processing system according to the present invention;

FIG. 4 (2) is a schematic block diagram showing the construction of an envelope processing unit 13 according to the present invention of the envelope generator 3 of FIG. 3;

DESCRIPTION OF THE PREFERRED EMBODIMENTS

Figure 1:
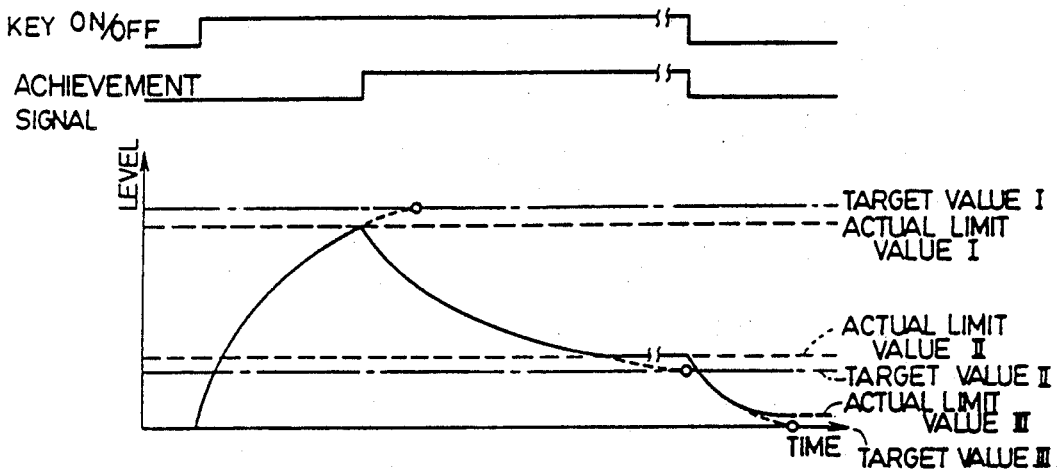
FIG. 1(1) PRIOR ART
FIG. 1 (1) is a graph of an envelope waveform for illustrating a conventional musical tone information processing system.
Figure 1:
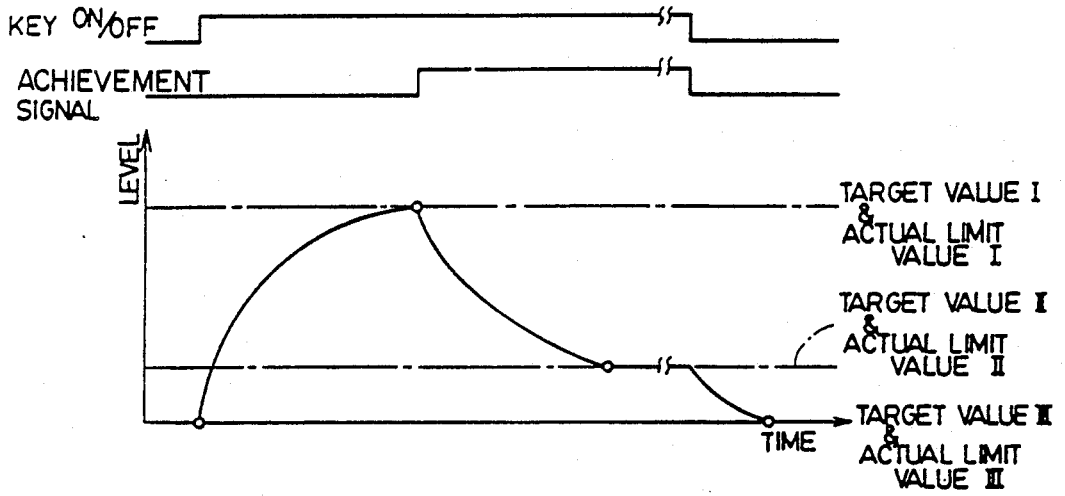

Hereinafter, a preferred embodiment of the present invention will be described in detail with reference to the accompanying drawings. Note, in the drawings, although the arrows are drawn by a single solid line, thus may indicate data represented by a plurality of bits.

Figure 2:
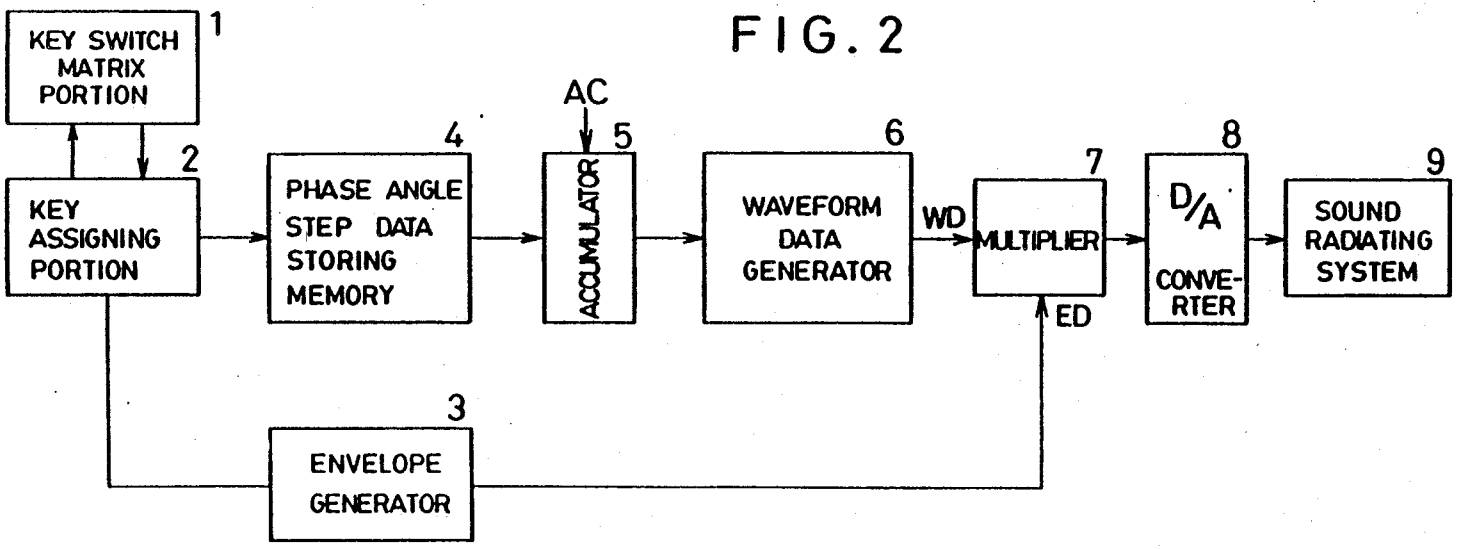
FIG. 2 is a schematic block diagram showing the overall construction of the electronic musical instrument of the present invention.

FIG. 2 shows the overall construction of a circuit of an electronic musical instrument. Switches of a key switch matrix portion 1, which have been turned on or off (namely, are in a key on or key off state), are scanned and detected by a key assigning portion 2, which controls the assignment of channels to the detected keys. Further, the key assigning portion 2 supplies a key on event signal indicating the time at which the key on is effected, and a key off event signal indicating the time, at which the key off is effected, to an envelope generator 3 which generates envelope data ED, i.e., data of an attack time, a decay time, a sustain time, as a release time of the envelope, and then outputs the generated data to a multiplier 7. Further, the key assigning portion 2 also supplies a key code corresponding to the turned-on switch (hereunder sometimes referred to as a key on switch) to a phase angle step data storing memory 4, whereupon phase angle step data (i.e. frequency number data) corresponding to a pitch indicated by the key code is read out of the phase angle step data storing memory 4 and accumulated by an accumulator 5 upon each application of a clock signal Ac having a constant period. Further, data represented by high order bits of the accumulated data is sent to a waveform data generator 6. Subsequently, musical tone waveform data WD is sequentially read from the waveform data generator 6 at a rate corresponding to the phase angle step data, and then multiplied by the envelope data ED in a multiplier 7. The result of the multiplication is sent through a digital-to-analog (D/A) converter 8 to a sound radiating device 9, which radiates or outputs sounds corresponding to the result of the multiplication.

Figure 3:
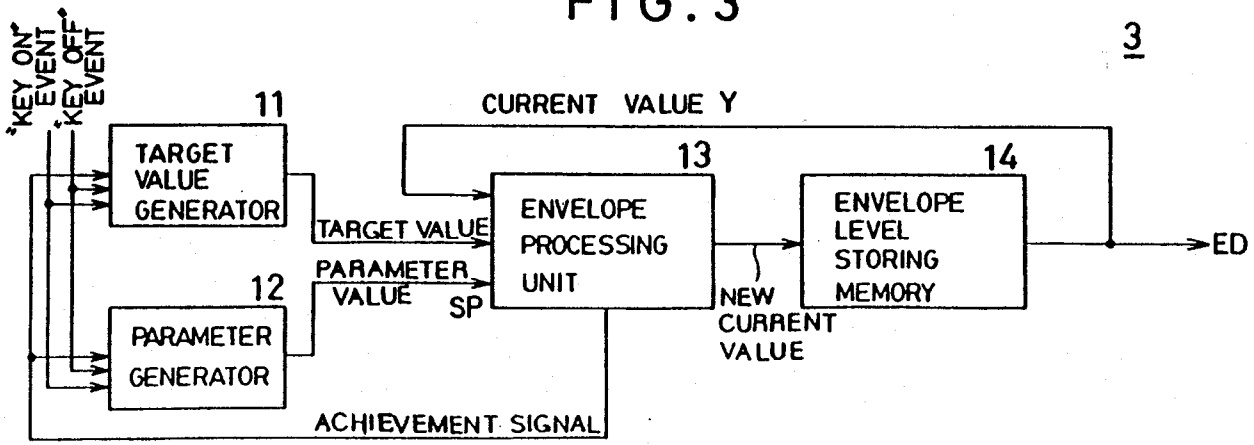
FIG. 3 is a schematic block diagram showing the construction of an envelope generator 3 of the electronic musical instrument of FIG. 2.

FIG. 3 shows the construction of the envelope generator 3 A target value generator 11 stores target values I, II and III indicated by white circles in FIG. 1 (2), and a parameter generator 12 stores parameters SP representing time constants which indicate the rates of changes in the levels of the attack time, the decay time, and the release time of the envelope shown in FIG. 1 (2), respectively.

The target value generator 11 and the parameter generator 12, each of which can be constructed by a memory and an address counter, store the target values I, II and III and the parameter SP, respectively. Further, the address counter is enabled by key on event signal and is incremented in response to an achievement signal received from an envelope processing unit 13. Furthermore, the key off event signal place the address counter into a state for addressing the target value III or the parameter SP. Note, in a polyphonic electronic musical instrument provided with a plurality of channels, the target value generator 11 and the parameter generator 12 can be adapted to output the target values, I, II and III and the parameter SP in a time-division manner corresponding to the number of channels.

Further, a signal representing a target value X sent from the target value generator 11, and another signal representing the parameter sent from the parameter generator 12, are supplied to the envelope processing unit 13, whereupon an arithmetic operation on a current value Y, as explained later, on the basis of the parameter SP for making the current value Y closer to the target value X is effected. A new current value Y obtained as a result of this operation is stored in each storage region, corresponding to a channel, of an envelope level storing memory 14 and is output as envelope data ED and supplied to the envelope processing unit 13.

Figure 4:
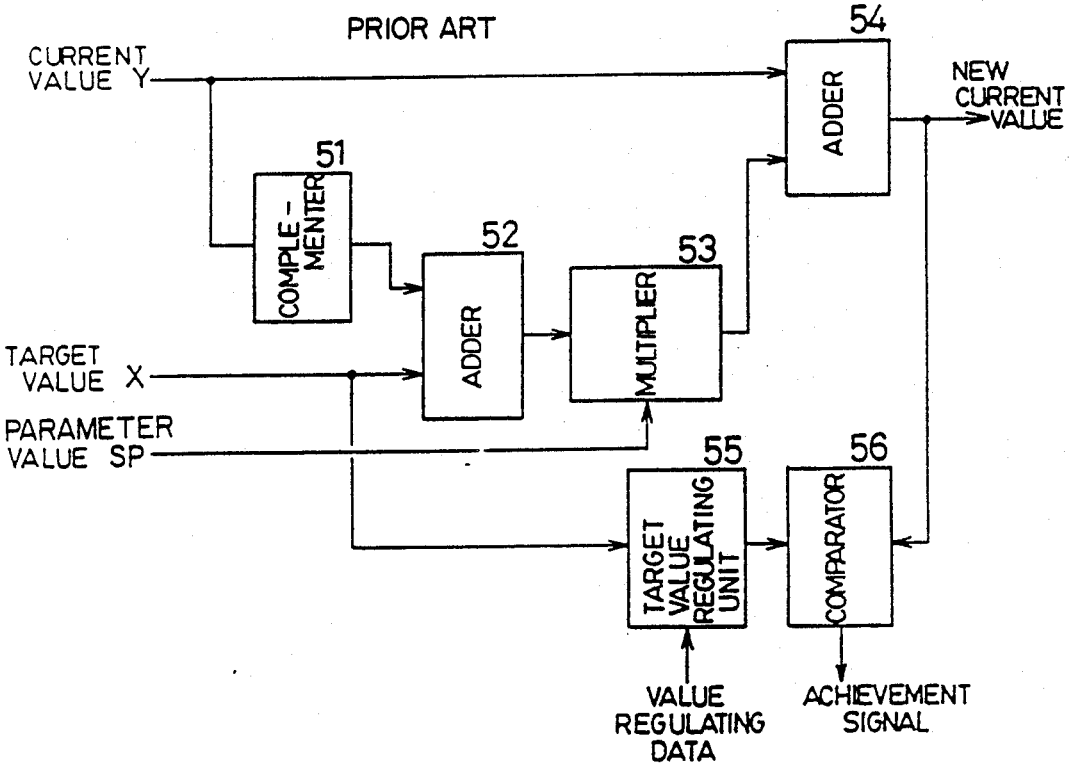
FIG. 4(1) PRIOR ART
FIG. 4 (1) is a schematic block diagram showing the construction of a conventional envelope processing unit 13 of the envelope generator 3 of FIG. 3.
Figure 4:
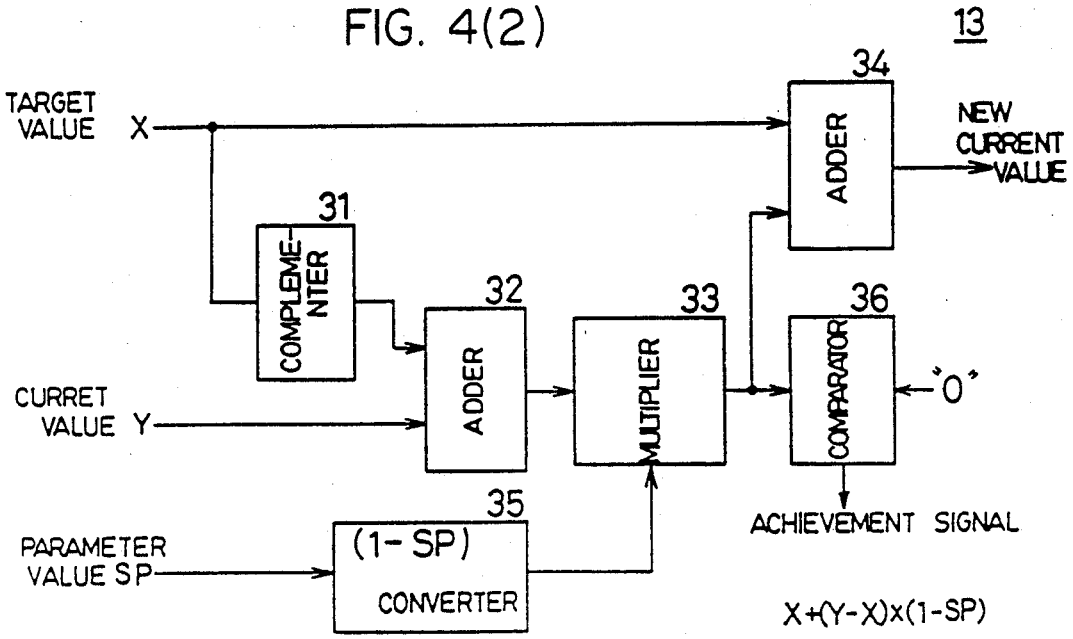

FIG. 4 (2) shows a practical construction of the envelope processing unit 13. In this unit 13, the target value X is first inverted by a complementer 31 and then added to the current value Y. Accordingly, the target value X is subtracted from the current value Y, and the difference between the target value X and the current value Y, i.e., (Y−X), is obtained. Subsequently, this difference data (Y−X)is multiplied by data (1−SP) obtained by inverting the parameter SP in a multiplier 33, to evaluate change data (Y−X)×(1−SP).

The inverted parameter (1−SP) defines the magnitude of the rate of change of the change data (Y−X)×(1−SP), and as the value of this inverted parameter is increased, the gradient or grade of the envelope curve shown in FIG. 1 (2) in attack, decay or release time is decreased. Further, as the current value Y becomes closer to the target value X, the difference (Y−X) is decreased, and thus the rate of change of the change data (Y−X)×(1−SP) approaches 0. Note, the difference data (Y−X) is not multiplied by the parameter SP but multiplied by the inverted parameter (1−SP), because the sign of the difference data in this case is different from that of the difference data (Y−X) in the conventional case of FIG. 4 (1). Further, it is apparent that, if the parameter SP is prestored in inverted form (1−SP) in the parameter generator 12, a parameter converter 35 for inverting the parameter SP sent from the parameter 12 becomes unnecessary.

The parameter converter 35 is composed up of a group of inverters and an adder, and the value represented by each of the bits of data representing the parameter SP is inverted by the group of the inverters, and the resultant data is output to the adder whereupon the resultant data is incremented by 1. Therefore, the "1" of the inverted data of the parameter SP, i.e., (1−SP), can be expressed in the binary form as "100 . . . 0" in which the number of "0"'s is equal to that of bits used for representing the parameter SP. Thereafter, the change data (Y−X)×(1−SP) is added to the target value X by an adder 34, and thus the new value Y is evaluated.

Further, along with the change data (Y−X)×(1−SP) from the multiplier 33, data representing 0 is supplied to this comparator 36. When the change data (Y−X)×(1−SP) is matched with 0, a coincidence signal is output from the comparator 36 as the achievement signal indicating that the change data matches 0 (i.e., the current value Y matches the target value X), and a further process with respect to the next target value is commenced.

In this embodiment, when turning to the process relating to the next target value, only the determining of whether or not the change data (Y−X)×(1−SP) matches 0 is performed, by using the comparator 36. Namely, this embodiment does not require the target value regulating device provided in the conventional envelope processing unit, and thus the construction of this embodiment can be simplified. Further, when completing the processing of the envelope data ED in any of the attack time, the decay time, and the release time, the reference data used in the judgement made by the comparator 36 is 0, and thus the content of the judgment process can be simplified. Furthermore, the arithmetic operation effected in the envelope processing unit 13 of FIG. 4 (2) is expressed by the following equation, X+(Y−X)×(1−SP), and thus the change data is added to the target value in a different manner to that of the conventional envelope processing unit of FIG. 4 (1), using the following equation Y+(X−Y)×SP. Therefore, when the change data becomes equal to 0, the current value Y output from the adder 34 is completely matched with the target value X. Namely, in this embodiment, the drawbacks of the conventional envelope processing unit that the actual limit values I, II and III, which are affected by the results of effecting the arithmetic operation in the attack time, the decay time, and the release time, do not reach the corresponding target values I, II and III, respectively, as shown in FIG. 1 (1) are eliminated. Namely, in the case of the envelope processing unit of the present invention, the actual limit values I, II and III completely reach the corresponding target values I, II and III, respectively, as shown in FIG. 1 (2).

Figure 5:
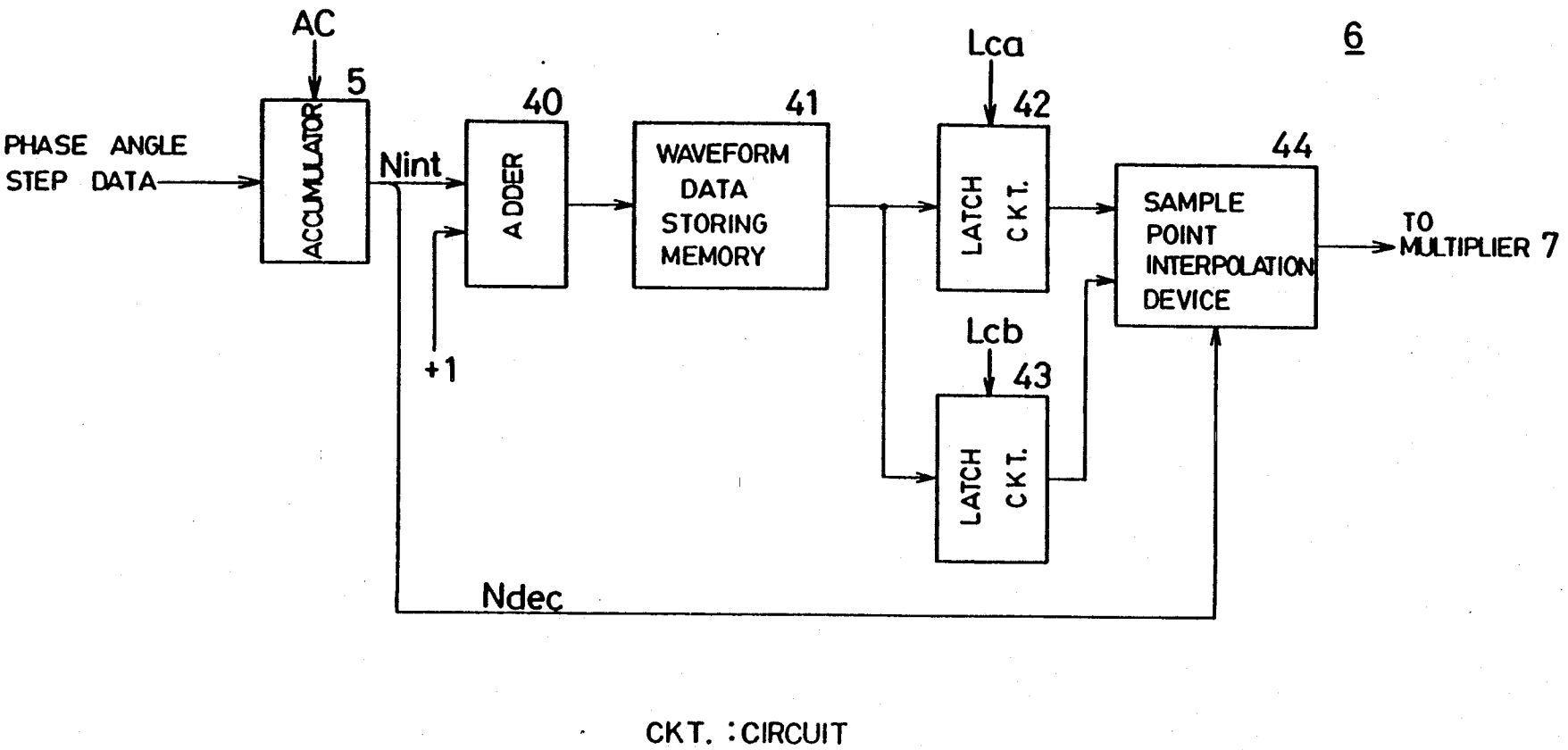
FIG. 5 is a schematic block diagram showing the construction of an example of a waveform data generator 6 of the electronic musical instrument of FIG. 2.

FIG. 5 shows the practical construction of the waveform data generator 6. Here, data Nint, represented by high order bits of the data N obtained by accumulating the phase angle step data from the accumulator 5, is supplied through the adder 40 to the waveform data storing memory 41. Further, a clock signal having a period equal to a time required for sending the data for one channel, is supplied to a carry-in terminal Cin of the adder 40. Moreover, the accumulated phase angle step data Nint and the data Nint+1, obtained by adding 1 to the data Nint, are alternately output from the adder 40 in a time-division manner.

Then the waveform data WD of the musical tone waveform at a step K corresponding to the accumulated phase angle step data Nint, and the waveform data WD+1 at the next step K+1 corresponding to the accumulated phase angle step data Nint+1, are read from the waveform data storing memory 41. Further, the waveform data WD is latched by a latch circuit 42 in response to the leading edge of the clock signal Lca, and the waveform data WD+1 is latched by another latch circuit 43 in response to the leading edge of the clock signal Lcb.

Thereafter, the waveform data WD and WD+1 are input to a sample point interpolation device 44, whereupon the levels of the waveform between the steps K and K+1 are obtained by using the data WD and WD+1 by effecting a linear interpolation method on the basis of data Ndec represented by low order bits of the accumulated phase angle step data N. Further, the results of the interpolation are output to the multiplier 7.

Figure 6:
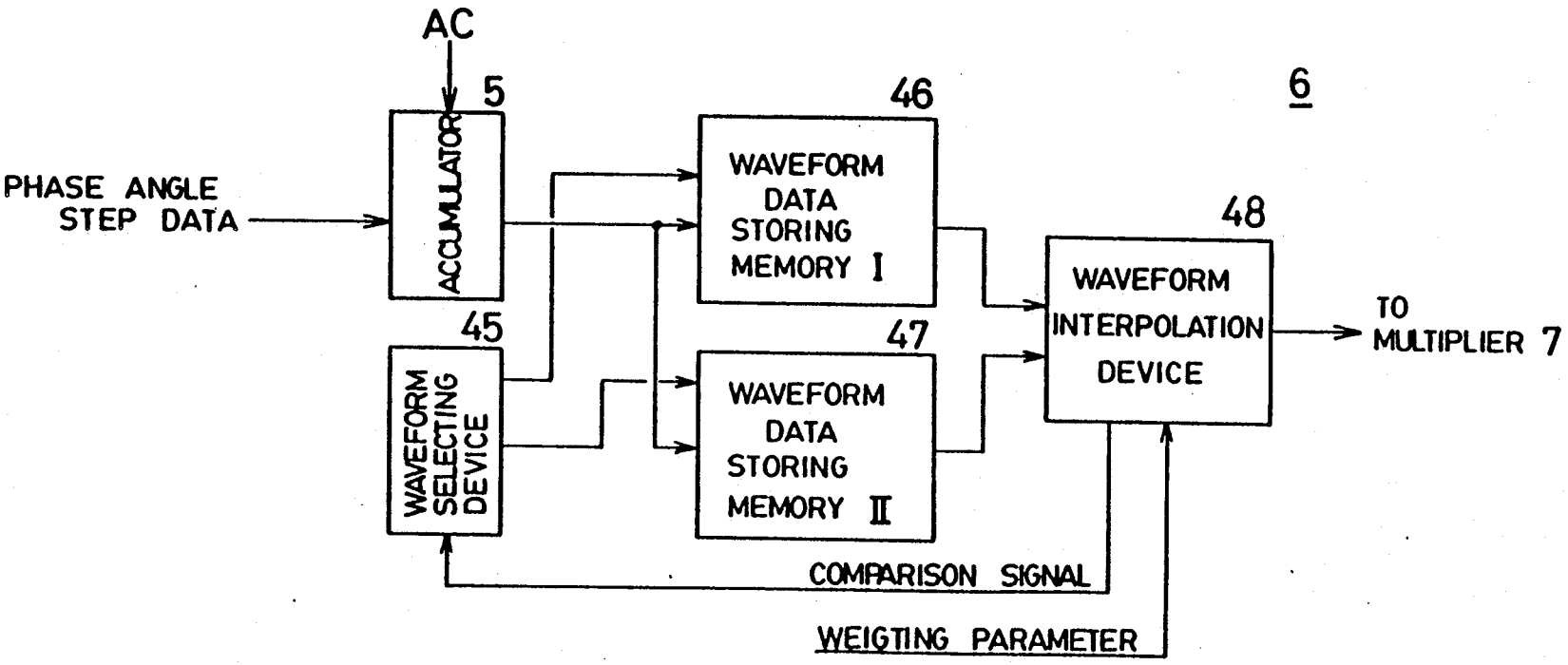
FIG. 6 is a schematic block diagram showing the construction of another example of a waveform data generator 6 of the electronic musical instrument of FIG. 2.

FIG. 6 shows the practical construction of another example of the waveform data generator 6. First, the data Nint represented by the high order bits of the accumulated phase angle step data from the accumulator 5 is supplied to the memories 46 and 47, and then two kinds of waveform data WD are read out of the memories 46 and 47 in parallel with each other. The respective two kinds of the waveform data WD thus read out are then weighted, on the basis of weighting parameters respectively corresponding to the two kinds of the waveform data WD, in a waveform interpolating device 48, and thereafter, added and synthesized. The interpolated musical tone waveform data is then output to the multiplier 7.

From this waveform interpolating device 48, comparison signals generated by comparing the weighting parameters with predetermined data are output at the time of starting the interpolation and at the time of terminating the interpolation, and are supplied to a waveform selecting device 45. This waveform selecting device 45 is controlled in such a manner that enable signals are supplied to both of the memories 46 and 47 during the interpolation but feed enable signals are supplied to only one of the memories 46 and 47 before and after the interpolation, so that the synthesized waveform is gradually varied from one of the waveforms, which are respectively selected from the memories 46 and 47, to the other.

Although a preferred embodiment of the present invention has been described above, it is understood that the present invention is not limited thereto and that other modifications will be apparent to those skilled in the art without departing from the spirit of the invention. For example, the circuit of FIG. 4 (1) may be combined with the comparator 36 of FIG. (2). Namely, the change data $(X-Y)\times SP$ output from the multiplier 53 of FIG. 4 (1) may be supplied to the comparator 36 of FIG. 4 (2), whereupon it is determined whether or not the change data matches 0. Although there are two groups of the target values (i.e., one of the groups is a group of "target values for calculation" corresponding to the target values I, II and III of FIG. 1 (1) and the other is a group of "actually achieved target values" corresponding to the actual limit values I, II and III of FIG. 1 (1)) such a case is the same as in the above-described preferred embodiment, in that the result of the arithmetic operation actually reaches to the target values (or "actually achieved target values") I, II and III. Further, it should be noted that the musical tone information processing system can be applied to waveform data used for realizing frequency or amplitude modulation effects such as a glide, a vibrato and so on, and waveform data representing the way in which a mixing rate used for mixing a plurality of musical tone waveforms changes with time, other than the envelope waveform.

The scope of the present invention, therefore, is to be determined solely by the appended claims.

We claim:

1. An envelope generator for use in an electronic musical instrument, comprising:

musical tone data processing means for evaluating a current value of musical tone envelope data with respect to a target value based on a parameter;

a target value generator for generating the target value and sending the target value to said musical tone data processing means;

a parameter generator for generating the parameter and sending the parameter to said musical tone data processing means;

changing rate control means for decrementing a change in the current value of the musical tone envelope data such that the current value becomes closer to the target value;

detection means for detecting whether or not the change is equal to 0 ; and processing control means for controlling said musical tone data processing means by stopping the evaluation of the current value of musical tone envelope data with respect to the target value in response to a result of a detection by said detection means.

2. The envelope generator for use in an electronic musical instrument of claim 1, wherein said musical tone data processing means is controlled by said processing control means such that said musical tone data processing means starts the evaluation of the change in the current value with respect to another target value when the change is equal to 0.

3. The envelope generator for use in an electronic musical instrument of claim 1, wherein said musical tone data processing means evaluates the change by calculating the difference between the current value and the target value.

4. The envelope generator for use in an electronic musical instrument of claim 1, wherein the musical tone envelope data is used for realizing frequency or amplitude modulation effects.

5. The envelope generator for use in an electronic musical instrument of claim 1, wherein the musical tone envelope data represents a way in which a mixing rate used for mixing a plurality of musical tone waveforms changes with time.

6. An envelope generator for use in an electronic musical instrument comprising:

a target value generator for generating a target value in response to a key on signal;

a parameter generator for generating a parameter value, equivalent to a time constant, in response to the key on signal;

enveloping processing means including, a complementer for receiving and inverting the target value, converting means for receiving the parameter value and subtracting the parameter value from the number 1 to produce a converter output, first adding means for adding a current value of envelope data to the inverted target value to produce an adder output, multiplying means for multiplying the adder output by the converter output to produce a multiplier output, comparing means for comparing the multiplier output to zero, and if the multiplier output equals zero, for sending an achievement signal to said target value generator and said parameter generator, and second adding means for adding the multiplier output to the target value to produce a new current value; and envelope level storing memory for storing the new current value and outputting the new current value as envelope data.

7. The envelope generator for use in an electronic musical instrument of claim 6, wherein the target and parameter value are attack time envelope data.

8. The envelope generator for use in an electronic musical instrument of claim 6, further comprising processing control means for controlling said envelope generator so that a target value and a parameter value are generated for attack time envelope data, decay time envelope data, and released time envelope data.

* * * * *